United States Patent [19]

Koizumi et al.

[11] Patent Number: 5,006,867

[45] Date of Patent: Apr. 9, 1991

[54] RECORDING HEAD FOR AN INK JET RECORDING APPARATUS HAVING A PLURALITY OF TEMPERATURE DETECTION ELEMENTS

[75] Inventors: Yutaka Koizumi, Tokyo; Minoru Nozawa; Toshihiro Mori, both of Hiratsuka; Atsushi Saito, Yokohama, all of Japan

[73] Assignee: Canon Kabushiki Kaisha, Tokyo, Japan

[21] Appl. No.: 518,238

[22] Filed: May 7, 1990

Related U.S. Application Data

[63] Continuation of Ser. No. 272,471, Nov. 17, 1988, abandoned.

[30] Foreign Application Priority Data

Nov. 20, 1987 [JP] Japan ..... 62-291965

[51] Int. Cl.[5] ..... B41J 2/195

[52] U.S. Cl. ..... 346/140 R; 374/112; 374/147

[58] Field of Search ..... 346/140; 374/147, 141, 374/112, 110; 219/330

[56] References Cited

U.S. PATENT DOCUMENTS

| | | | |
|---|---|---|---|
| 4,106,030 | 8/1978 | Hampton | 346/140 |
| 4,459,469 | 7/1984 | Ishima | 346/140 X |
| 4,590,362 | 5/1986 | Ishima | 346/140 X |

FOREIGN PATENT DOCUMENTS

| | | |
|---|---|---|
| 57-146681 | 9/1982 | Japan . |
| 60-002370 | 1/1985 | Japan . |
| 62-144956 | 6/1987 | Japan . |

*Primary Examiner*—Joseph W. Hartary

*Attorney, Agent, or Firm*—Fitzpatrick, Cella, Harper & Scinto

[57] ABSTRACT

A recording head for an ink jet recording apparatus having a common chamber for supplying ink to a plurality of ink discharge portions each having an electric-heat converting member. A plurality of temperature detecting elements in the head measure the temperature at different locations in the chamber and an adjuster equalizes the temperature distribution of the chamber based on temperature information from the temperature detecting devices.

10 Claims, 5 Drawing Sheets

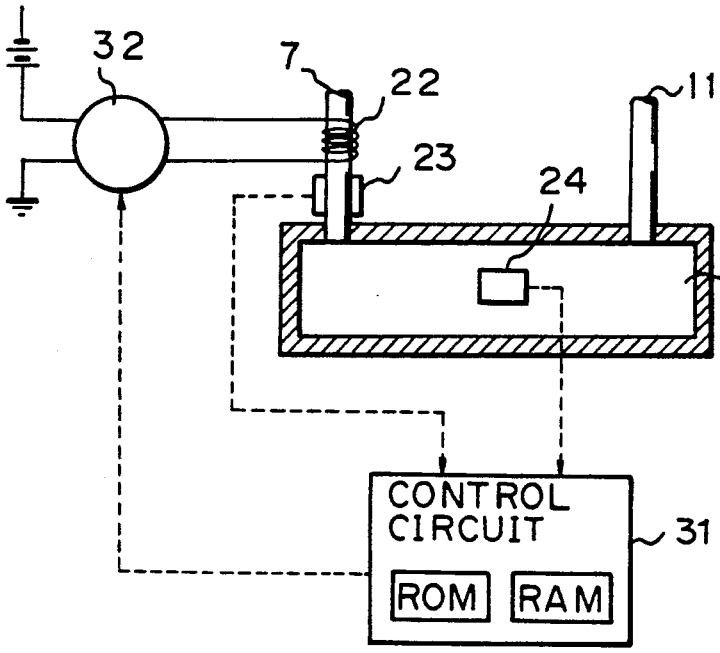
Fig. 4
Fig. 6
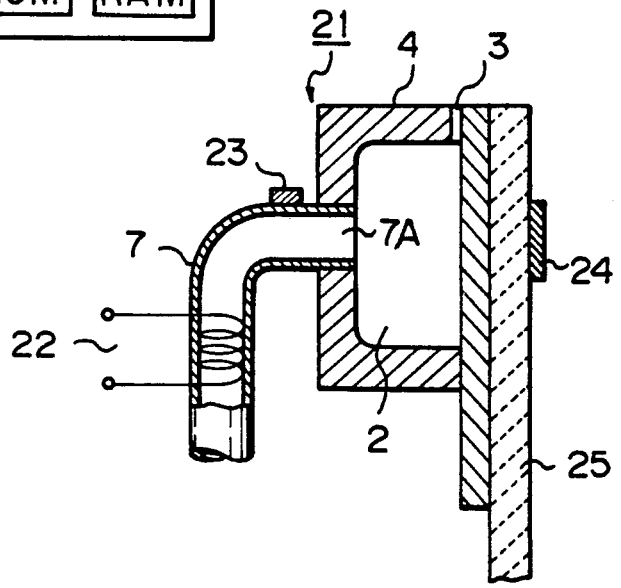
Fig. 7
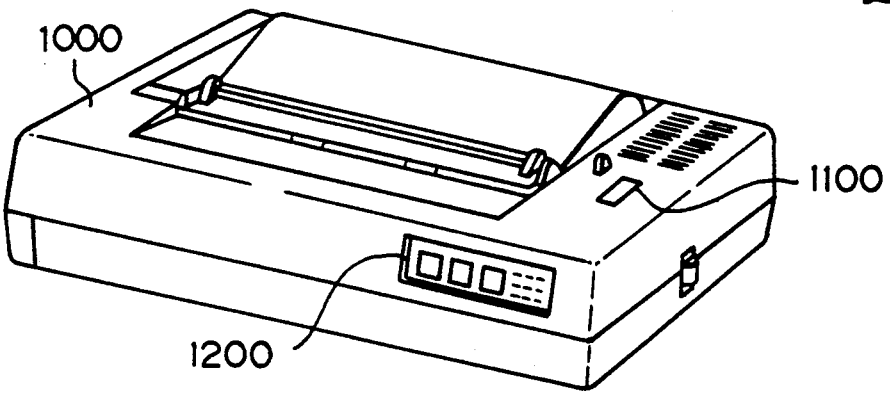

RECORDING HEAD FOR AN INK JET RECORDING APPARATUS HAVING A PLURALITY OF TEMPERATURE DETECTION ELEMENTS

This application is a continuation of application Ser. No. 07/272,471, filed Nov. 17, 1988, now abandoned.

BACKGROUND OF THE INVENTION

1. Field of the Invention

This invention relates to a liquid injection recording head and a liquid injection recording apparatus provided with the head, and in particular to a liquid injection recording head of the full multitype in which recording elements used to discharge recording liquid from a discharge opening and accomplish recording by flying liquid droplets are arranged by a number corresponding to the recording width, and a liquid injection recording apparatus provided with such head.

2. Description of the Related Background Art

As for liquid injection recording heads of this type, there have heretofore been proposed various heads such as a head in which a pressure charge is produced in the liquid in a liquid path by deformation of a piezoelectric element to thereby discharge minute liquid droplets, a head in which a pair of electrodes are provided near a discharge opening to thereby deflect liquid droplets and accomplish recording, and a head in which a heat generating element disposed in a liquid path is suddenly caused to generate heat to thereby produce bubbles in the liquid and the bubbles are utilized to discharge the liquid as liquid droplets from a discharge opening.

Among these, the last-mentioned system utilizing heat energy can be said to be particularly effective liquid injection recording head because of its feature that highly dense arrangement of discharge openings is easy and high-speed recording is possible. Also, as such a recording head, there are known as the serial scan type and the full multi (full line) type in which recording elements are arranged corresponding to the recording width, but from the viewpoint of high-speed recording, the full multitype is apparently more advantageous.

FIG. 1 of the accompanying drawing shows an example of the construction of a liquid injection recording head of such full multitype and the ink supply means thereof. In FIG. 1, the reference numeral 1 designates the recording head, the reference numeral 2 denotes a common liquid chamber in the recording head 1, and the reference numeral 3 designates discharge openings for liquid discharge arranged in a recording liquid discharge opening surface 4. The discharge openings 3 in the present example are arranged over the full recordable width of a recording material to be recorded and heat generating elements which are energy generating means provided in a liquid path, not shown, leading to the individual discharge openings 3 are selectively driven to thereby discharge the recording liquid, whereby recording can be accomplished without the main scanning of the head the heat itself. In the heat generating elements, use is made, for example, of electro-thermal converting members each having a heat generating resistance layer and an electrode connected to the heat generating resistance layer.

The reference numeral 5 designates a recording liquid supply tank for supplying the recording liquid to the recording head 1, and the reference numeral 6 denotes a main tank for replenishing the supply tank 5 with the recording liquid. The recording liquid is supplied from the supply tank 5 to the common liquid chamber 2 of the recording head 1 by a supply tube 7, and during the replenishment with the recording liquid, the recording liquid can be supplied from the main tank 6 to the supply tank 5 by a pump 9 for recovery through a one-way rectifying valve 8 for replenishment. The reference numeral 10 designates a one-way rectifying valve for recovery during the recovering operation effected to recover the discharging function of the recording head 1, the reference numeral 11 denotes a circulation tube in which the rectifying valve 10 for recovery is disposed, the reference numeral 12 designates an electromagnetic valve disposed in the aforementioned first supply tube 7, and the reference numeral 13 denotes a vent valve for the supply tank.

In the recording head 1 thus constructed, and the recording liquid supply system and recovering system thereof, the electromagnetic valve 12 is kept open during recording, and the recording liquid is supplied from the gravity or the like thereof from the supply tank 5 to the common liquid chamber 2 and is directed from the liquid chamber 2 to the discharge openings 3 through a liquid path, not shown. Also, during the recovering operation carried out to remove bubbles remaining in the common liquid chamber 2 and the supply system and cool the recording head 1, the pump 9 for recovery is driven to supply the recording liquid into the common liquid chamber 2 by the circulation tube 11, and the recording liquid can be returned from the common liquid chamber 2 to the supply tank 5 by the first supply tube 7. Further, during the initial filling of the liquid path or the like with the recording liquid, the recording liquid can be forced into the common liquid chamber 2 via the circulation tube 11, which is the second supply tube, by the pump 9 with the electromagnetic valve 12 closed, whereby bubbles can be discharged and the recording liquid can be discharged from the discharge openings 3.

However, in the conventional multi-nozzle type liquid injection recording head, as described above, when high-density recording such as solid recording by the head generating elements, particularly, high-speed recording by the high-frequency driving of the heat generating elements, is carried out, any excess heat not used for recording (to form liquid droplets) and heat generated from a driver for driving the heat generating elements accumulate during long-time recording and, moreover, a temperature gradient by such heat distribution may sometimes occur to the recording liquid in the common liquid chamber.

Describing such a phenomenon with reference to FIGS. 2A–2C of the accompanying drawings, in the case of a recording head as shown in FIG. 2B, the temperature of the recording liquid inevitably becomes high near the central portion of the recording head and the the temperature of the recording liquid supplied is low because it accommodates itself to the environmental temperature. So, the recording liquid in the common liquid chamber assumes the temperature gradient as shown in FIG. 2C and as a result, a difference occurs in the viscosity of the recording liquid, and liquid droplets discharged from the right discharge opening which is at a high temperature become greater in viscosity than liquid droplets discharged from the left discharge opening, whereby on a recording medium 30 shown in FIG. 2A, the record on the right half becomes dense or dark as compared with the record on the left half and thus, the quality of recording is spoiled. Such a tendency becomes more remarkable as the number of discharge openings becomes greater, e.g. 128 or 256, and some countermeasure has been desired.

SUMMARY OF THE INVENTION

It is an object of the present invention to solve the above-noted problem peculiar to the prior art and to provide a liquid injection recording head in which the temperature gradient of the recording liquid in a common liquid chamber is controlled so as to be always within an allowed range.

It is another object of the present invention to provide a liquid injection recording head characterized by the provision of a liquid path communicating with a discharge a opening for discharging recording liquid therethrough, first temperature detecting means for detecting the temperature of the recording liquid introduced into said liquid path, second temperature detecting means provided at a location discrete from said first temperature detecting means for detecting the temperature of the recording liquid introduced into said liquid path, and heating means for heating the recording liquid in conformity with the result of the detection by said first and second temperature detecting means.

According to the liquid injection recording head of the present invention, the recording liquid is heated to a temperature suitable for discharge by the heating means provided near the supply port of a supply tube to the common liquid chamber, and it has become possible to ON-OFF-Control the heating means by temperature information from both a temperature sensor provided in the common liquid chamber and a temperature sensor provided at the entrance of the common liquid chamber to thereby control the recording liquid so that the temperature gradient of the recording liquid harmful to recording may not occur in the common liquid chamber.

BRIEF DESCRIPTION OF THE DRAWINGS

FIG. 4 shows the construction of a control circuit for recording liquid heating means according to the present invention.

FIG. 6 is a cross-sectional view showing the construction of a liquid injection recording head according to another embodiment of the present invention.

FIG. 7 is a schematic perspective view of a liquid injection recording apparatus provided with the liquid injection recording head of the present invention.

DESCRIPTION OF THE PREFERRED EMBODIMENT

Some embodiments of the present invention will hereinafter be described in detail and specifically, with reference to the drawings.

Figure 1:
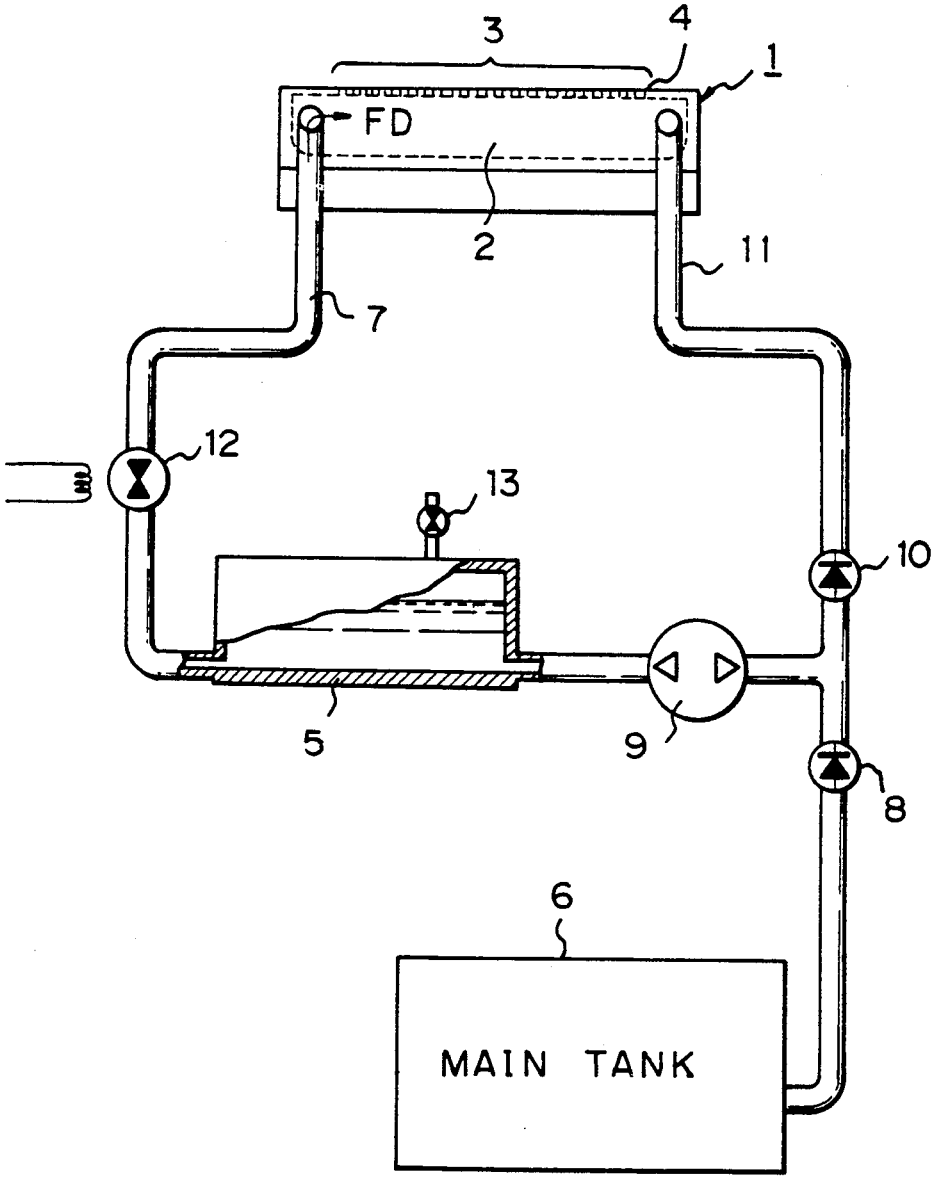
Fig. 1 PRIOR ART
FIG. 1 is a schematic view showing an example of the construction of a liquid injection recording head according to the prior art and the recording liquid supply system and the circulation system thereof.
Figure 2A:
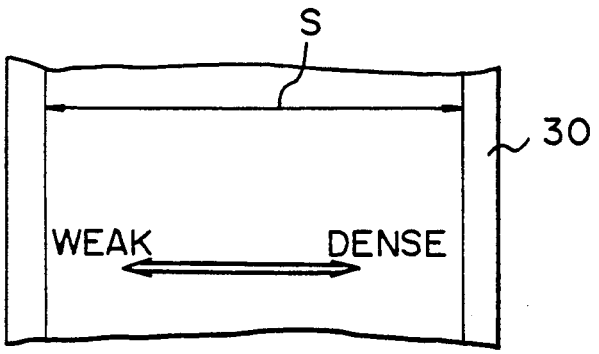
Fig. 2A PRIOR ART
FIGS. 2A–2C illustrate a problem peculiar to the recording head of FIG. 1.
Figure 2B:
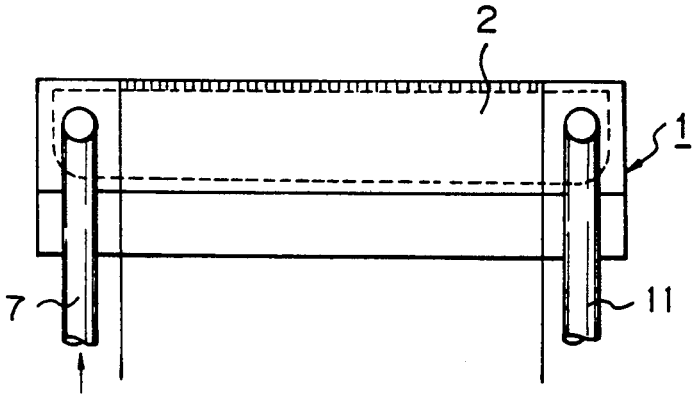
Fig. 2B PRIOR ART
Figure 2C:
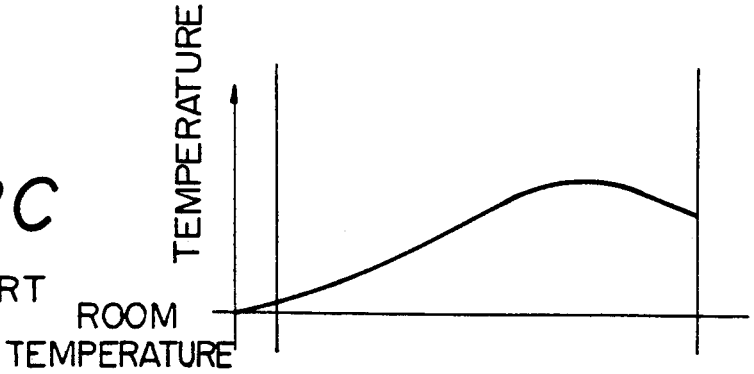
Fig. 2C PRIOR ART
Figure 3A:
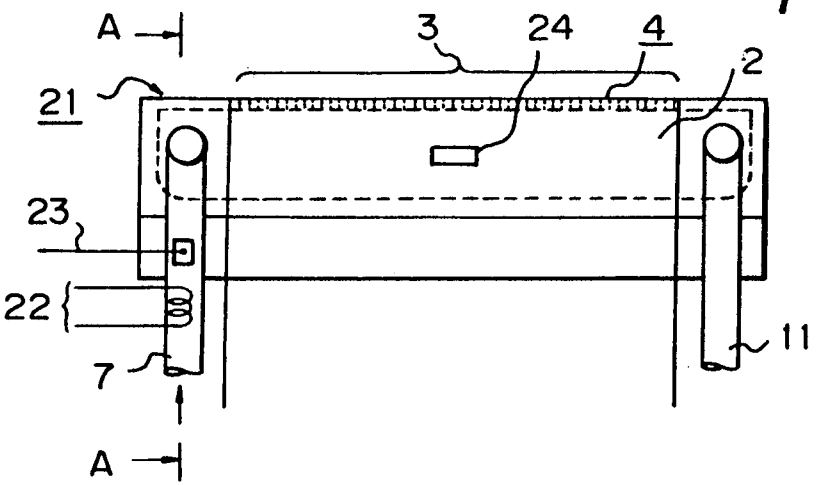
FIG. 3A is a schematic top plan view showing an embodiment of the liquid injection recording head of the present invention.
Figure 3B:
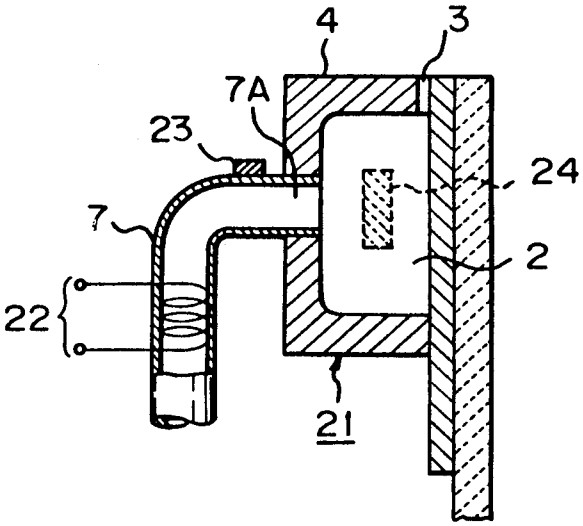
FIG. 3B is a schematic cross-sectional view taken along line A—A of FIG. 3A.
Figure 3C:
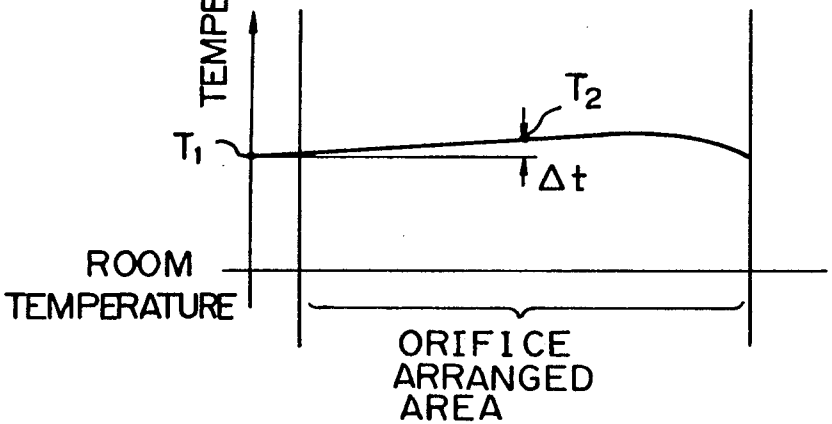
FIG. 3C is a graph showing the temperature distribution of recording liquid in the common liquid chamber of the recording head shown in FIG. 3A and the gradient thereof.

FIGS. 3A and 3B show an embodiment of the present invention. In the recording head 21 of the present embodiment, the reference numeral 22 designates heating means, i.e., a heater, provided near the supply port 7A of a first supply tube 7. A first temperature sensor 23 which is first temperature detecting means is provided on the first supply tube 7 downstream of the heater 22, and a second temperature sensor 24 which is second temperature detecting means is provided near the substantially central portion of a common liquid chamber 2. That is, in the present embodiment, by appropriately ON-OFF-Controlling the heater 22 as will be described later, the temperature difference $\Delta t$ between the temperature T1 detected by the first temperature sensor 23 and the temperature T2 detected by the second temperature sensor 24 is controlled so as to be within a predetermined temperature range as shown in FIG. 3C. The applicant confirmed by experiments that if the range of the temperature difference $\Delta t$ is 1° C.–15° C., there occurs no difference in light and shade to the resultant record.

FIG. 4 shows the construction of a circuit for carrying out the above-described temperature control. In FIG. 4, the reference numeral 31 denotes a control circuit provided with the function of a CPU and having memory devices ROM and RAM. The reference numeral 32 designates switching means for switching on and off the heater 22. In the control circuit 31, when the detection signals T1 and T2 from the first temperature sensor 23 and the second temperature sensor 24 are input, the temperature difference $\Delta t = T2 - T1$ is calculated and the calculated temperature difference $\Delta t$ is controlled so as to be within a predetermined temperature range $t_{max} - t_{min}$ (as described above, $t_{max}$ and $t_{min}$ are appropriately preset within the range of 1° C.–15° C.).

Figure 5:
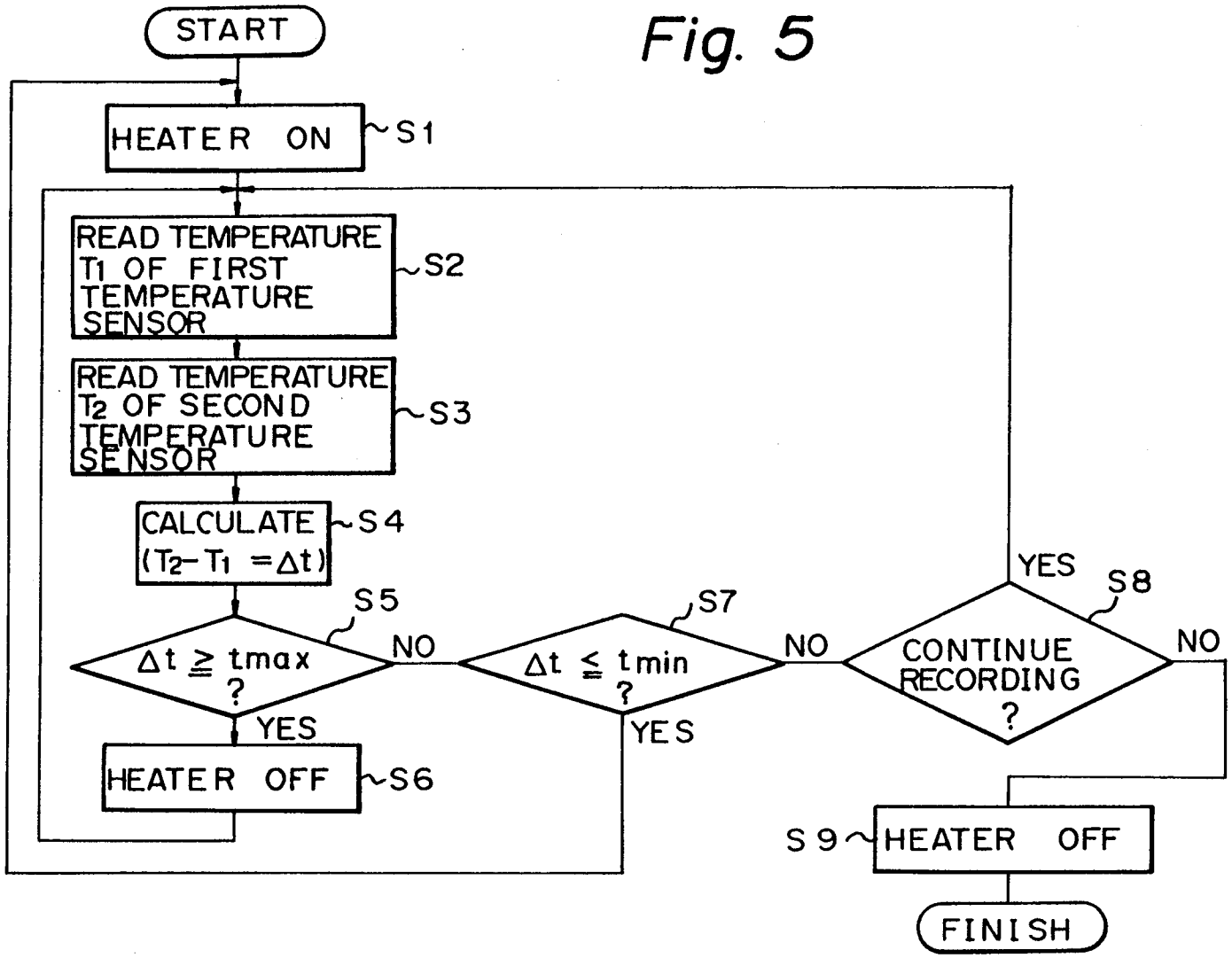
FIG. 5 is a flow chart showing the procedure of the operation of controlling the heating means.

The controlling operation will now be described with reference to FIG. 5. First, at step S1, the switching means 32 is switched "on" to supply electric power to the heater 22, and the steps S2 and S3, the detected temperatures T1 and T2 from the first temperature sensor 23 and the second temperature sensor 24 are read, respectively. Then, at step S4, the temperature difference $\Delta t = T2 - T1$ is calculated, and at the next step S5, whether the temperature difference $\Delta t$ is more than the maximum allowed limit temperature $t_{max}$ is judged. If it is thus judged that the temperature difference $\Delta t$ is more than the temperature $t_{max}$, advance is made to step S6, where the switching means 32 is switched "off" and the supply of electric power to the heater, 22 is stopped,. and return is made to step S2, and during the ensuing steps S3–S5, the temperature different $\Delta t$ becoming lower than the temperature $t_{max}$ is waited for. Also, if at step S5, it is judged that the temperature difference $\Delta t$ is lower than the temperature $t_{max}$, branching-off is made to step S7, where whether the temperature difference $\Delta t$ is less than the minimum allowed limit temperature $t_{min}$ is judged.

If at step S7, it is judged that the temperature difference $\Delta t$ is less than the temperature $t_{min}$, return is made to step S1, where electric power is supplied to the heater 22, whereafter step S2 and the subsequent steps are repeated, and if the temperature difference $\Delta t$ is higher than the temperature $t_{min}$, advance is further made to step S8, where whether recording should be continued is judged. If it is thus judged that recording should be continued, return is made to step S2, and if it is judged that recording need not be continued, the supply of electric power to the heater 22 is stopped at step S9

In the above-described embodiment, the second temperature sensor 24 is provided near the substantially central portion in the common liquid chamber 2, but alternatively, as shown in FIG. 6, the second temperature sensor 24 may be provided, for example, along the head supporting plate 25 of the recording head near the central portion thereof. In such case, the detected temperature T2' from the second temperature sensor 24 becomes different from the temperature T2 described in connection with FIG. 3C, but the tendency of the temperature gradient is similar to that which is shown in FIG. 3C and therefore, likewise, by calculating $\Delta t' = T2' - T1$, the ON-OFF control of the heater 22 can be carried out in accordance with the flow shown in FIG. 5.

Also, in the foregoing, it has been described that the second temperature sensor is provided near the substantially central portion of the common liquid chamber or the head supporting plate so as to be suitable for remarkably grasping the temperature difference, but of course, the location thereof is not limited thereto if it is a location which enables the temperature difference $\Delta t$ to be clearly recognized.

The above-described embodiment is one of the most preferable embodiments of the present invention, but the present invention covers the following various modifications if it is a head capable of controlling the temperature of recording liquid in conformity with the difference between the temperature detected by the first temperature sensor and the temperature detected by the second temperature sensor:

(1) a liquid injection recording head in which the first temperature sensor is provided near the port for the supply of the recording liquid to the liquid injection recording head and the second temperature sensor is provided near the communication port of the circulation tube with the liquid injection recording head; and (2) a liquid injection recording head in which the first temperature sensor is provided at the substantially central portion of the common liquid chamber and the second temperature sensor is provided near the communication port of the circulation tube with the liquid injection recording head.

Also, the first and second temperature sensor may be provided inside or outside the liquid path.

Further, in the foregoing, the so-called full multitype liquid injection recording head has been mentioned as one of the most preferable embodiments of the present invention, whereas the present invention is not always restricted to the head of this type, but is also applicable to a head in which there may arise the aforementioned problem peculiar to the prior art due to the partiality of the temperature distribution of the recording liquid in the liquid chamber, for example, a head which has a plurality of discharge openings but is not of the full multitype.

In addition, in the foregoing, a head has been mentioned in which the direction in which the recording liquid is discharged from the discharge opening is substantially the same as the direction in which the recording liquid is supplied to the location in the liquid path at which the energy generating means is provided, whereas the present invention is not restricted thereto. The present invention is also applicable for example, to a head in which the direction in which the recording liquid is discharged from the discharged opening differs from the direction in which the recording liquid is supplied to the location in the liquid path at which the energy generating means is provided (for example, said two directions are substantially perpendicular to each other).

Also, in the foregoing, a liquid injection recording head using a heat generating element as the energy generating means generating energy used to discharge recording liquid has been mentioned as one of the most preferable embodiments of the present invention, whereas the present invention is not restricted to the head of this type, but is also applicable to a liquid injection recording head using an electro-mechanical converting member such as a piezo-electric element as the energy generating means if it is a head in which there may arise the aforementioned problem peculiar to the prior art due to the partiality of the temperature distribution of the recording liquid in the liquid chamber. FIG. 7 is a schematic perspective view of a liquid injection recording apparatus provided with the abovedescribed liquid injection recording head. In FIG. 7, the reference numeral 1000 designates the apparatus body, the reference numeral 1100 denotes a power source switch, and the reference numeral 1200 designates an operation panel.

As described above, according to the present invention, means for heating the recording liquid is provided in the supply tube near the recording liquid supply port provided in the common liquid chamber and, therefore, it becomes possible to suppress the temperature gradient of the recording liquid in the common liquid chamber, and the variation in the size of formed recording liquid droplets can be suppressed to thereby eliminate the density difference of record on the recording material, and further, if said heating means is controlled so as to be switched on and off in association with the temperature of the recording liquid in the common liquid chamber and near the supply port, recording can be carried out more effectively and thus, a liquid injection recording head particularly suitable for the full multitype can be provided.

We claim:

1. A recording head for an ink jet recording apparatus provided with a temperature adjusting device, said recording head comprising:

a discharging area provided with a plurality of ink discharging portions each having an electric-heat converting member;

a common chamber for receiving ink, said common chamber communicated with said discharging area and supplying ink to each of said ink discharging portions;

a plurality of temperature detecting elements for detecting temperature at different locations of said common chamber; and heat controlling means for equalizing the temperature distribution of said common chamber in response to temperatures detected by said plurality of temperature detecting elements;

wherein the temperature distribution is equalized by adjusting the temperature of ink supplied to said common chamber.

2. A recording head for an ink jet recording apparatus according to claim 1, wherein said discharging area has more than 128 electric-heat converting members.

3. A recording head for an ink jet recording apparatus according to claim 1, wherein said discharging area has more than 256 electric-heat converting members.

4. A recording head for an ink jet recording apparatus according to claim 1, wherein said discharging area is arranged to record over the whole width of a recording material, and one of said temperature detecting elements is disposed on a side area that receives the ink to be supplemented into said common chamber.

5. An ink jet recording apparatus comprising:

a recording head including a discharging area provided with a plurality of ink discharging portions each having an electric-heat converting member, and a common chamber for receiving ink, said common chamber communicated with said discharging area and supplying ink to each of said ink discharging portions;

first and second temperature detecting elements for detecting temperature at different locations of said common chamber; and an adjuster for equalizing the temperature distribution of said common chamber based on temperature information from said first and second temperature detecting elements;

wherein the temperature distribution is equalized by adjusting the temperature of ink supplied to said common chamber.

6. An ink jet recording apparatus according to claim 5, wherein said adjuster has said first temperature detecting element at a side area receiving the ink to be supplemented into said common chamber, and raises the temperature at said side area in response to the temperature detected by said first and second temperature detecting elements.

7. An ink jet recording apparatus according to claim 6, wherein said adjuster has a heater at said side area, and said first temperature detecting element is disposed near said heater, between said heater and said discharging area where said electric-heat converting member is disposed.

8. An ink jet recording apparatus according to claim 5, wherein said adjuster controls the temperature difference based on the temperature information from said first and second temperature detecting elements to a predetermined value within a range of 1°-15° C.

9. An ink jet recording apparatus comprising:

a recording head provided with a plurality of ink discharging portions each having an electric-heat converting member capable of full-line recording, and a common liquid chamber for receiving ink, said common chamber communicated with said discharging area and supplying ink to each of said ink discharging portions;

first and second temperature detecting elements disposed at different positions with respect to a full-line recording direction of said recording head and outputting temperature information corresponding to a temperature distribution of said common liquid chamber; and an adjuster for equalizing the temperature distribution corresponding to said first and second temperature detecting elements;

wherein the temperature distribution is equalized by adjusting the temperature of ink supplied to said common chamber.

10. An ink jet recording apparatus according to claim 9, wherein said adjuster has a heater for controlling the temperature difference between said first and second temperature detecting elements to a predetermined value.

* * * * *